US011766120B2

(12) United States Patent
Leitner et al.

(10) Patent No.: US 11,766,120 B2
(45) Date of Patent: Sep. 26, 2023

(54) HOLDING DEVICE FOR HOLDING A DECORATIVE PANEL WHICH CAN BE PLACED ONTO A DRAWER SIDE WALL

(71) Applicant: Julius Blum GmbH, Hoechst (AT)

(72) Inventors: Marcel Leitner, Wolfurt (AT); Markus Riezler, Dornbirn (AT); Markus Kampl, Dornbirn (AT); Marcel Madlener, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 18/075,724

(22) Filed: Dec. 6, 2022

(65) Prior Publication Data

US 2023/0097170 A1 Mar. 30, 2023

Related U.S. Application Data

(63) Continuation of application No. PCT/AT2021/060217, filed on Jun. 22, 2021.

(30) Foreign Application Priority Data

Jul. 6, 2020 (AT) ..... A 50577/2020

(51) Int. Cl.
*A47B 88/925* (2017.01)
*A47B 88/95* (2017.01)
*A47B 88/90* (2017.01)

(52) U.S. Cl.
CPC ..... *A47B 88/925* (2017.01); *A47B 2088/902* (2017.01); *A47B 2088/952* (2017.01)

(58) Field of Classification Search
CPC ..... A47B 88/90; A47B 88/925; A47B 88/941; A47B 88/944; A47B 88/95;
(Continued)

(56) References Cited

U.S. PATENT DOCUMENTS 4,802,716 A 2/1989 Röck et al.
4,804,239 A 2/1989 Röck et al.
(Continued)

FOREIGN PATENT DOCUMENTS

AT 515689 B1 * 11/2015 ..... A47B 88/956
CN 103200844 7/2013
(Continued)

OTHER PUBLICATIONS

International Search Report dated Sep. 30, 2021 in International (PCT) Application No. PCT/AT2021/060217.

*Primary Examiner* — Andrew M Roersma
(74) *Attorney, Agent, or Firm* — Wenderoth, Lind & Ponack, L.L.P.

(57) ABSTRACT

A holding device including a fastening device for fixing the holding device to a front panel or to a drawer rear wall, and at least two mutually spaced holding limbs between which a decorative plate can be partially received. The at least two holding limbs are part of a clamping device for applying a clamping force to the decorative plate received between the at least two holding limbs in a direction extending transverse to a longitudinal direction of the decorative plate. The clamping device includes at least one adjustment device for adjusting the clamping force that can be applied to the decorative plate between the at least two holding limbs.

20 Claims, 6 Drawing Sheets

(58) Field of Classification Search
CPC ..... A47B 88/0014; A47B 88/0044; A47B 88/0051; A47B 2088/902; A47B 2088/951; A47B 2088/952; A47B 2088/0037; A47B 2088/0059; A47B 2088/0062; A47B 2088/0007; A47B 2210/09
See application file for complete search history.

(56) References Cited

U.S. PATENT DOCUMENTS

| | | | |
|---|---|---|---|
| 4,815,796 | A | 3/1989 | Röck et al. |
| 2017/0258229 | A1 | 9/2017 | Siffel |

FOREIGN PATENT DOCUMENTS

| | | | | | |
|---|---|---|---|---|---|
| DE | 202014104931 | U1 | * | 2/2016 | ..... A47B 88/941 |
| DE | 202015100770 | U1 | * | 6/2016 | ..... A47B 88/941 |
| EP | 1 397 981 | | | 3/2004 | |
| EP | 3 009 040 | | | 4/2016 | |
| EP | 3556249 | A1 | * | 10/2019 | ..... A47B 88/941 |
| FR | 2 603 672 | | | 3/1988 | |
| WO | 2010/094532 | | | 8/2010 | |
| WO | 2012/062605 | | | 5/2012 | |
| WO | 2015/192154 | | | 12/2015 | |
| WO | 2016/131579 | | | 8/2016 | |
| WO | WO-2016131579 | A1 | * | 8/2016 | ..... A47B 88/941 |
| WO | WO-2016131603 | A1 | * | 8/2016 | ..... A47B 88/90 |
| WO | WO-2018140992 | A1 | * | 8/2018 | ..... A47B 88/925 |
| WO | WO-2018166838 | A1 | * | 9/2018 | ..... A47B 88/925 |
| WO | WO-2018166839 | A1 | * | 9/2018 | ..... A47B 88/925 |
| WO | WO-2021037528 | A1 | * | 3/2021 | ..... A47B 88/941 |
| WO | WO-2021185902 | A1 | * | 9/2021 | |

* cited by examiner

HOLDING DEVICE FOR HOLDING A DECORATIVE PANEL WHICH CAN BE PLACED ONTO A DRAWER SIDE WALL

BACKGROUND OF THE INVENTION

The present invention relates to a holding device for holding a decorative plate, in particular a glass panel, configured to be set onto a drawer sidewall, the holding device includes:

- a fastening device for fixing the holding device to a front panel or to a drawer rear wall,
- at least two mutually spaced holding limbs between which the decorative plate can be partially received,
- wherein the at least two holding limbs are part of a clamping device for applying a clamping force to the decorative plate received between the at least two holding limbs in a direction extending transverse to a longitudinal direction of the decorative plate.

Moreover, the invention concerns an attachment device for a drawer sidewall, the attachment device being configured to enlarge a surface of the drawer sidewall in a direction extending transverse to the longitudinal direction of the drawer sidewall, and the attachment device includes at least one, preferably two, holding device(s) of the type to be described.

Finally, the invention relates to a method for mounting a decorative plate to at least one holding device of the type to be described.

A generic holding device for holding a decorative plate for drawers is disclosed, for example, in WO 2015/192154 A1. The decorative plate serves for enlarging the receiving volume of a drawer and can be configured as a decorative insert made of glass, wood, stone, plastic or ceramics. A bore is arranged in the front-end region and in the rear-end region of the decorative plate. A pin of a metal enforcement engages into a bore on a first side of the decorative plate, and a sleeve of an additional holder engages into the bore on an opposing second side of the decorative plate. A drawback is the fact that the production of a bore in the decorative plate is connected with a significant expenditure. Moreover, with the production of a bore in the decorative plate, there is also the danger that the decorative plate may crack during the drilling operation and can, therefore, no longer be used. Drawers with a holding device for fixing a plate-shaped wall element are shown in EP 2 637 524 A1, WO 2016/131579 A1, EP 2 398 350 A1 and in EP 3 009 040 A1. These holding devices each include a substantially U-shaped component having two side limbs between which the plate-shaped wall element can be arranged. A drawback is the fact that the U-shaped component must be precisely adapted to the dimensions of the wall element in order for the plate-shaped wall element to be fixed without clearance. Otherwise, there is the danger that the wall element wiggles in a mounted condition, and makes itself noticeable with disturbing noises upon a movement of the drawer, in particular when reaching the two end positions.

SUMMARY OF THE INVENTION

It is an object of the present invention to propose a holding device of the type mentioned in the introductory part, thereby avoiding the above-discussed drawbacks.

According to the invention, the clamping device includes at least one adjustment device for adjusting the clamping force that can be applied to the decorative plate between the at least two holding limbs.

In other words, the decorative plate is clampingly held in position by the at least two holding limbs in a mounted condition on the holding device. This has the particular advantage that it is not necessary for the decorative plate to be elaborately finished in order to be fixed to the holding device, that is to say that bores of the decorative plate can thus be prevented. Accordingly, the decorative plate can be configured entirely free from openings or recesses.

The provision of such an adjustment device has the advantage that the clamping force of the holding limbs that can be applied to the decorative plate can be variably adjusted by a user, and can be optimally adapted (that is to say without clearance) to the respective dimensions of the decorative plate. For example, the adjustment device offers the possibility to respectively increase the clamping force of the holding limbs when the decorative plate has become loose, and the decorative plate can be again fixed in a clamping manner.

The adjustment device can include, for example, at least one clamping screw connected or configured to be connected to the at least two holding limbs. Of course, the adjustment device can also include a rotationally supported adjustment wheel or a movably-supported clamping element for fixing the decorative plate in a force-locking manner.

The at least two holding limbs of the holding device can be made of a metallic material for example. The surface of the holding limbs intended for the contact with the decorative plate can be provided with a surface coating so as to increase the static friction and so as to provide a soft resting of the holding limbs on the decorative plate.

BRIEF DESCRIPTION OF THE DRAWINGS

Further details and advantages of the present invention result from the following description of figures.

DETAILED DESCRIPTION OF THE INVENTION

Figure 1A:
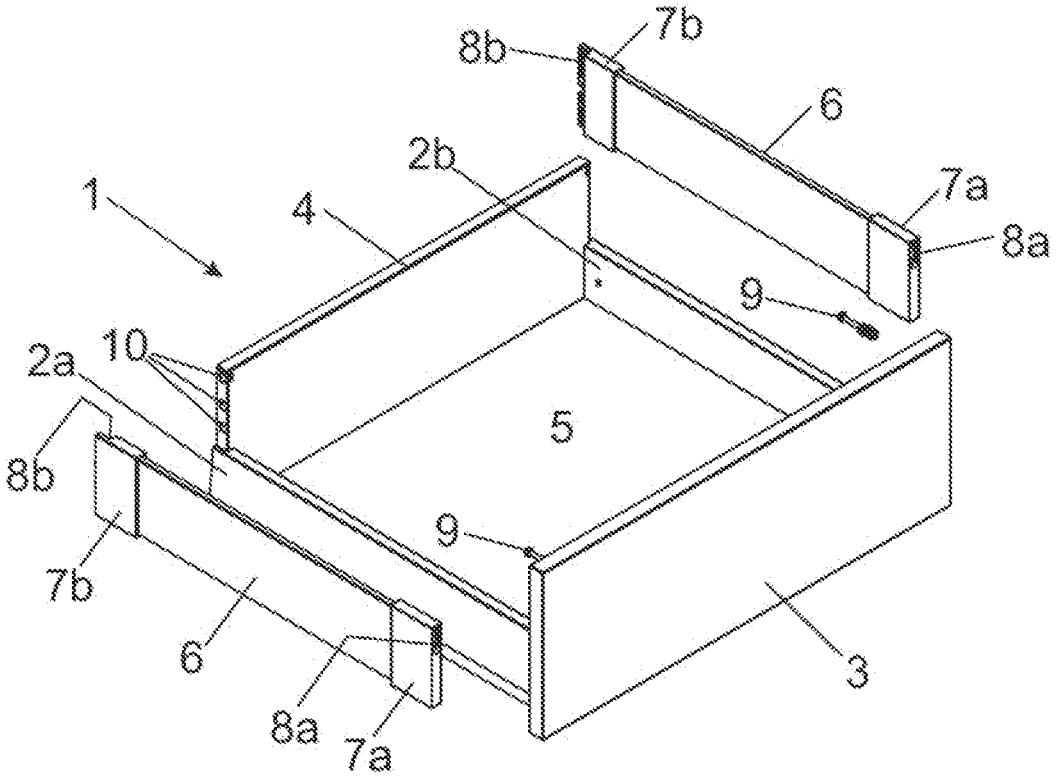
FIGS. 1*a*, 1*b* show a drawer in an exploded view and in an assembled condition.

FIG. 1*a* shows a drawer 1 in an exploded view. The drawer 1 includes two drawer sidewalls 2*a*, 2*b*, a front panel 3, a drawer rear wall 4 and a drawer bottom 5. For increasing the receiving volume of the drawer 1, decorative plates 6 are provided. The decorative plates 6 are configured to be set onto the sidewalls 2*a*, 2*b* and can be made, for example, of glass, stone, wood, ceramics, plastic or of a compound material (in particular a composite glass).

The cuboidal decorative plates 6 can be releasably connected via holding devices 7*a*, 7*b* to the front panel 3 on the one hand, and to the drawer rear wall 4 on the other hand. Each of the holding devices 7*a*, 7*b* includes a fastening device 8*a*, 8*b*, and the front fastening device 8*a* is configured to be fixed to the front panel 3 and the rear fastening device 8*b* is configured to be fixed to the drawer rear wall 4.

Figure 1B:
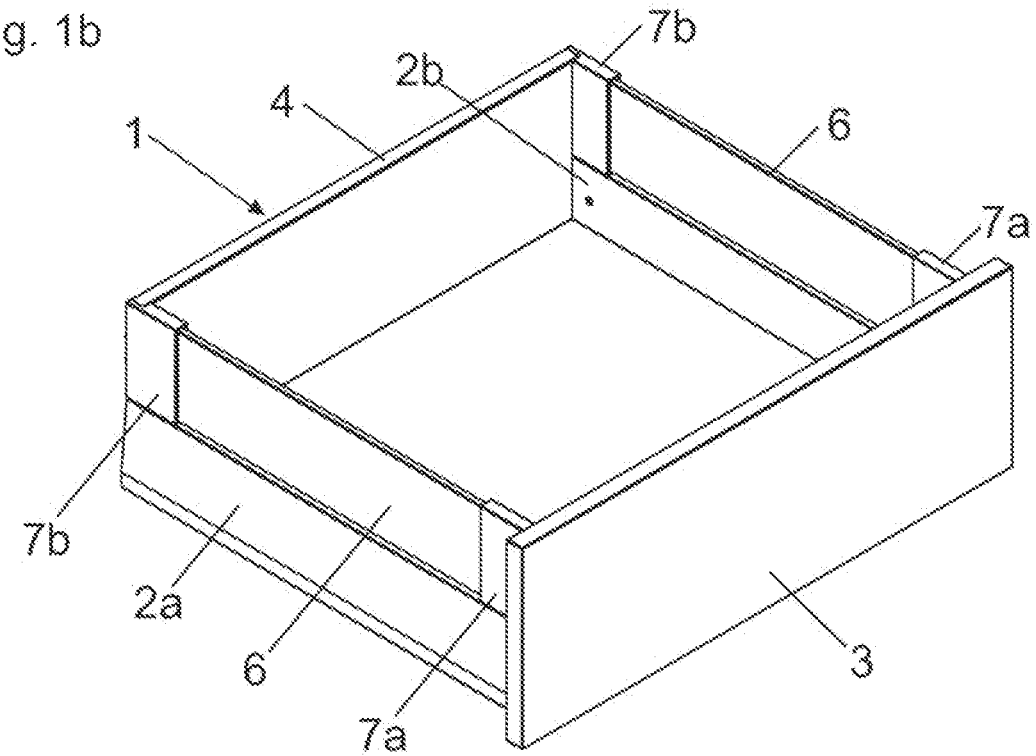

For example, the front fastening device 8*a* can be configured to be releasably connected, preferably locked, to a, preferably pin-shaped, fitting element 9 configured to be fixed to the front panel 3. In contrast, the rear fastening device 8*b* can be configured to be releasably connected, preferably locked, to openings 10 arranged on the drawer rear wall 4. FIG. 1*b* shows the drawer 1 depicted in FIG. 1*a* in an assembled condition.

Figure 2A:
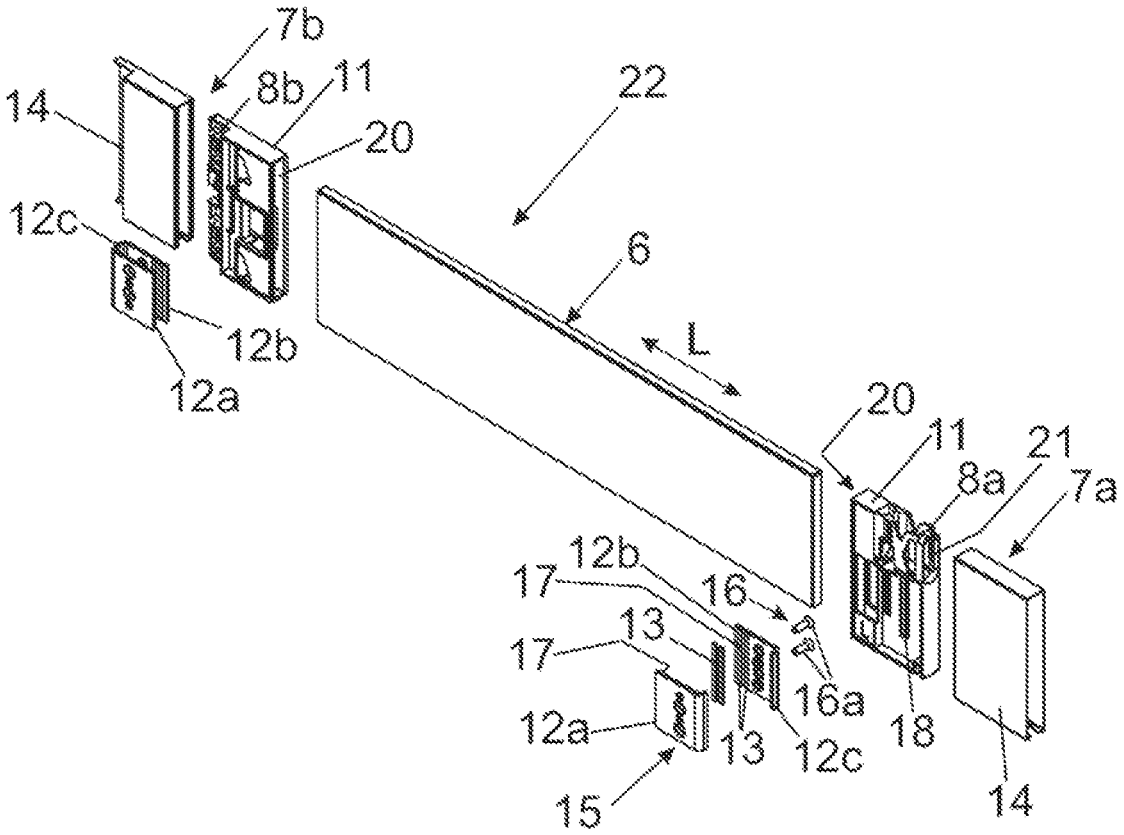
FIGS. 2*a*, 2*b* show an attachment device with a decorative plate and two holding devices in an exploded view and in an assembled condition.
Figure 2B:
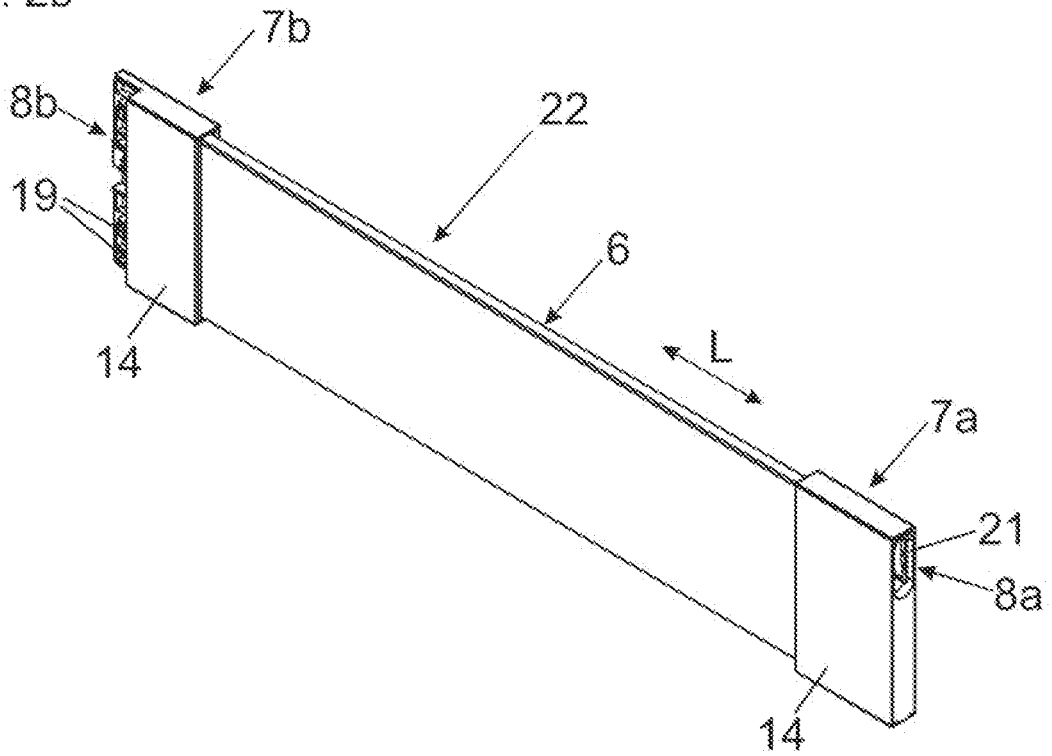

FIG. 2*a* shows an exploded view of an attachment device 22 for the drawer sidewall 2*a*, 2*b*. By the attachment device 22, a surface of the drawer sidewall 2*a*, 2*b* in a direction extending transverse to a longitudinal direction (L) of the drawer sidewall 2*a*, 2*b* can be enlarged.

Each of the holding devices 7*a*, 7*b* includes a base body 11 having a receiving chamber 20 configured to receive an end portion of the decorative plate 6. Moreover, a bearing device 18 for bearing two holding limbs 12*a*, 12*b* is arranged on the base body 11.

The decorative plate 6 can be partially received between the two holding limbs 12*a*, 12*b*. The at least two holding limbs 12*a*, 12*b* are part of a clamping device 15 configured to apply a clamping force to the decorative plate 6 when received between the at least two holding limbs 12*a*, 12*b* in a direction extending transverse to a longitudinal direction (L) of the decorative plate 6. In this way, the decorative plate 6, in its mounted condition, can be held by the two holding limbs 12*a*, 12*b* in a clamping manner. In the shown embodiment, the at least two holding limbs 12*a*, 12*b* are connected to one another or are configured to be connected to one another by at least one transverse limb 12*c*.

According to an embodiment, at least one, preferably both, of the at least two holding limbs 12*a*, 12*b* includes a clamping surface 17 configured to clampingly rest on the decorative plate 6, preferably wherein the clamping surface 17

- includes at least one, preferably two, elastic compensating element(s) 13, and/or
- is configured substantially flat, that is to say free from protrusions to be countersunk within the decorative plate 6.

According to the invention, the clamping device 15 includes at least one adjustment device 16 for adjusting a clamping force that can be applied to the decorative plate 6 between the at least two holding limbs 12*a*, 12*b*. For example, the adjustment device 16 can include at least one clamping screw 16*a* that is connected or that can be connected to the at least two holding limbs 12*a*, 12*b*.

Moreover, at least one cover device 14 can be provided, and the at least two holding limbs 12*a*, 12*b* of the holding device 7*a*, 7*b* can be covered by the at least one cover device 14. According to an embodiment, it can be provided that the at least two holding devices 12*a*, 12*b* can be clamped onto the decorative plate 6 by placing the at least one cover device 14 over the at least two holding limbs 12*a*, 12*b*.

The fastening device 8*a*, 8*b* for fixing the holding device 7*a*, 7*b* to the front panel 3 or to the drawer rear wall 4 can include, for example, a hole 21, preferably a keyhole, for introducing the fitting element 9 configured to be fixed to the front panel 3 and/or for introducing at least one locking protrusion 19 for fixing the drawer rear wall 4. The at least one locking protrusion 19 is configured to be locked into a corresponding opening 10 (FIG. 1*a*) of the drawer rear wall 4.

The base body 11 can include at least one spring element (not shown here), and a clearance occurring in the longitudinal direction (L) of the decorative plate 6 can be at least partially compensated for by the at least one spring element. For example, the spring element can be formed by an elastically yielding material portion or by a shaped spring.

Figure 3A:
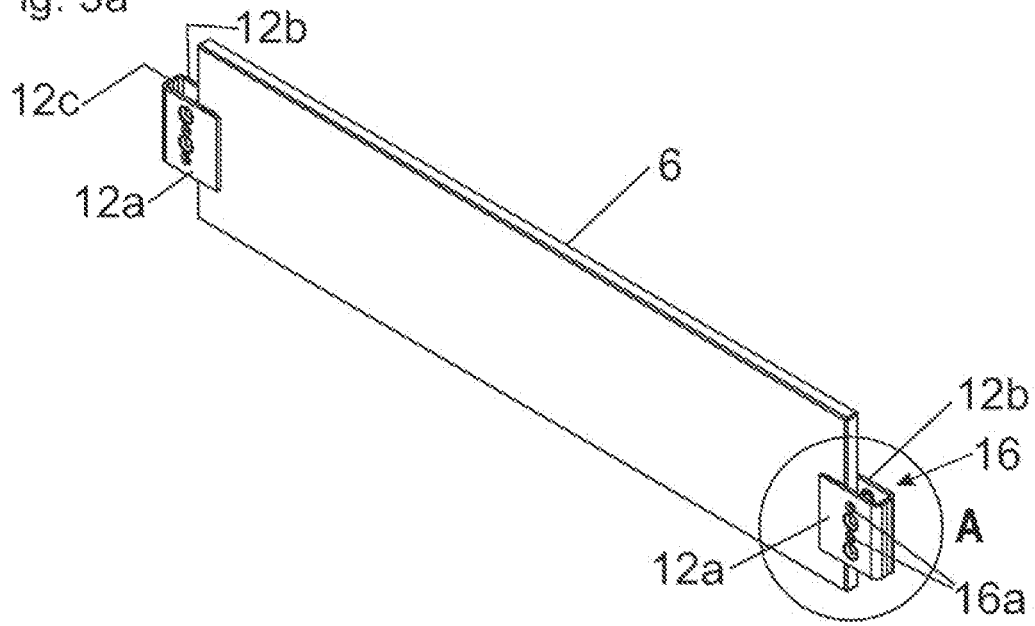
FIGS. 3*a*-3*c* show the decorative plate with the adjustable holding limbs resting against the decorative plate in a perspective view and in an enlarged detail view, and a non-inventive embodiment of the holding limbs without adjusting the clamping force.
Figure 3B:
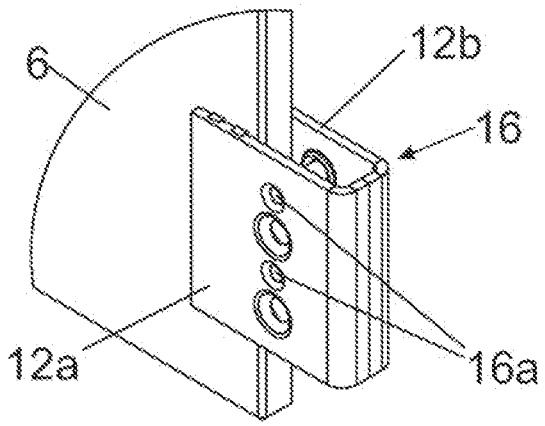

FIG. 3*a* shows the decorative plate 6, and the two holding limbs 12*a*, 12*b* of the holding device 7*a*, 7*b* clampingly embrace the decorative plate 6. By the adjustment device 16, the clamping force that can be applied to the decorative plate 6 between the at least two holding limbs 12*a*, 12*b* can be adjusted. By rotating the two clamping screws 16*a* with the aid of a tool, the clamping force can be variably adjusted. FIG. 3*b* shows the encircled region of FIG. 3*a* in an enlarged view.

Figure 3C:
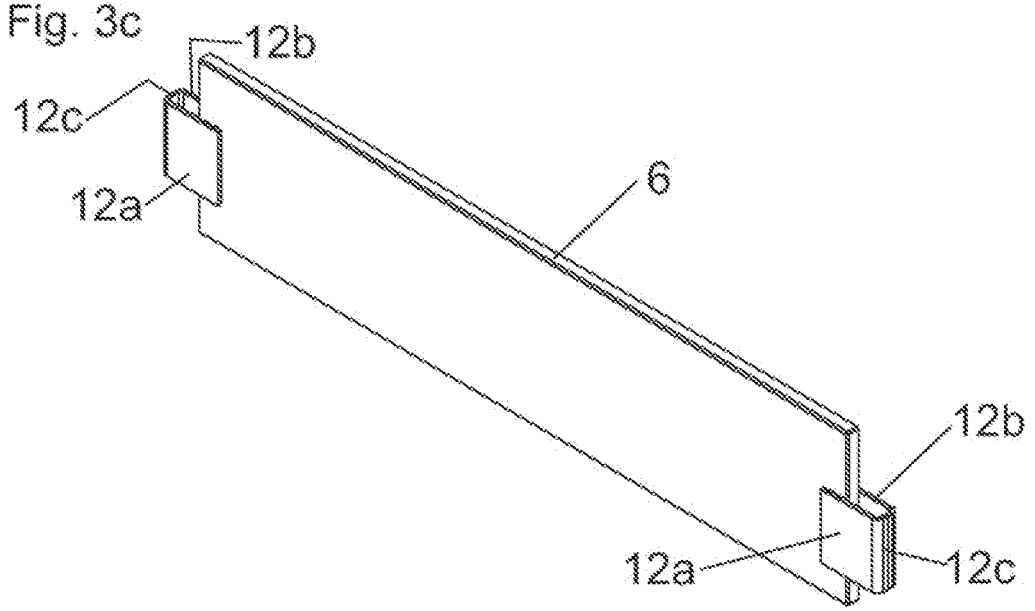

FIG. 3*c* shows a non-inventive embodiment in which the two holding limbs 12*a*, 12*b* embrace the decorative plate 6 in clamping manner. In contrast to the embodiment shown in FIGS. 3*a*, 3*b*, the adjustment device 16 is omitted here. The two holding limbs 12*a*, 12*b* thus bear against the decorative plate 6 with a pre-stressing force. This can be realized such that the two holding limbs 12*a*, 12*b* can be spread apart relative to one another upon receiving the decorative plate 6.

According to an embodiment, the holding device 7*a*, 7*b* includes at least one base body 11, and each of the at least two holding limbs 12*a*, 12*b* includes a first end to which the holding limbs 12*a*, 12*b* can be connected to the base body 11. A second end of the holding limbs 12*a*, 12*b* is configured to rest against the decorative plate 6. It can be preferably provided that a distance between the at least two holding limbs 12*a*, 12*b*, in a direction extending transverse to a longitudinal direction (L) of the decorative plate 6, from the first ends in a direction of the second ends decreases, and the second ends of the at least two holding limbs 12*a*, 12*b* can be spread apart relative to one another upon receiving the decorative plate 6.

Figure 4A:
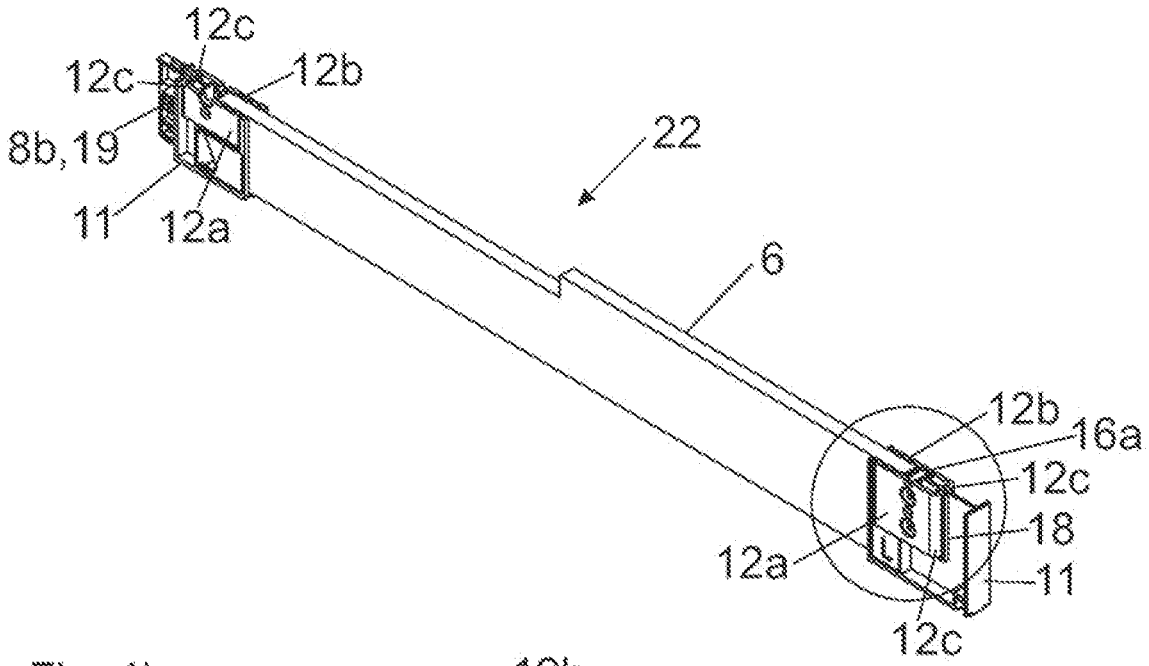
FIGS. 4*a*-4*c* show the attachment device in three different cross-sectional views.
Figure 4B:
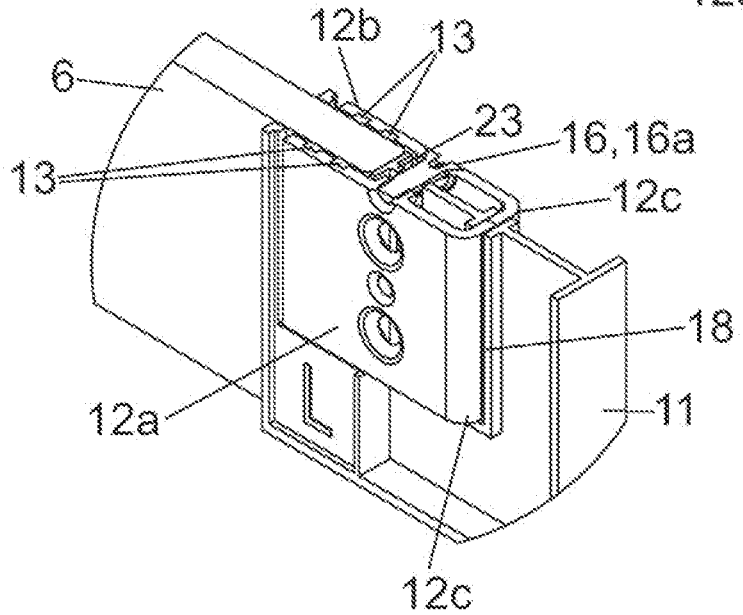
Figure 4C:
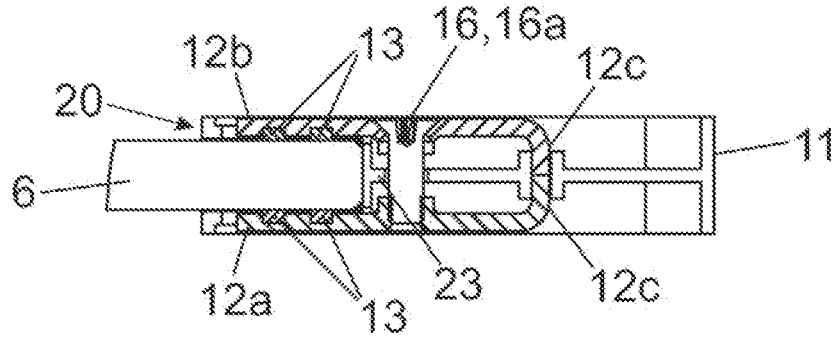

FIG. 4*a*-4*c* show the attachment device 22 in three different cross-sectional views. By the attachment device 22, the height of the drawer sidewall 2*a*, 2*b* and thus the receiving volume of the drawer 1 can be enlarged.

FIG. 4*a* shows a perspective cross-sectional view of the attachment device 22. Each of the two end portions of the decorative plate 6 is clampingly embraced by the two holding limbs 12*a*, 12*b*. The two holding limbs 12*a*, 12*b* are connected to each other by at least one transverse limb 12*c* so as to form a U-shaped clamp, jointly with the transverse limb 12*c*. By the adjustment device 16, which includes at least one clamping screw 16*a* for example, the clamping force of the holding limbs 12*a*, 12*b* acting onto the two outer sides of the decorative plate 6 is adjustable.

FIG. 4*b* shows the encircled region of FIG. 4*a* in an enlarged view. By the compensating elements 13, the decorative plate 6, in its mounted condition, is fixed without clearance within the two holding limbs 12*a*, 12*b* in a direction extending transverse to the longitudinal direction (L) of the decorative plate 6.

According to an embodiment, at least one limiting element 23 is arranged between the at least two holding limbs 12*a*, 12*b*, and the clamping force that can be applied to the decorative plate 6 can be limited by the at least one limiting element 23. In other words, the limiting element 23 forms an abutment for the two holding limbs 12*a*, 12*b* so as to prevent an undue actuation of the adjustment device 16. In this way, the decorative plate 6 can be protected from damages. FIG. 4*c* shows the portion of the attachment device 22 shown in FIG. 4*b* in a horizontal cross-sectional view.

Figure 5A:
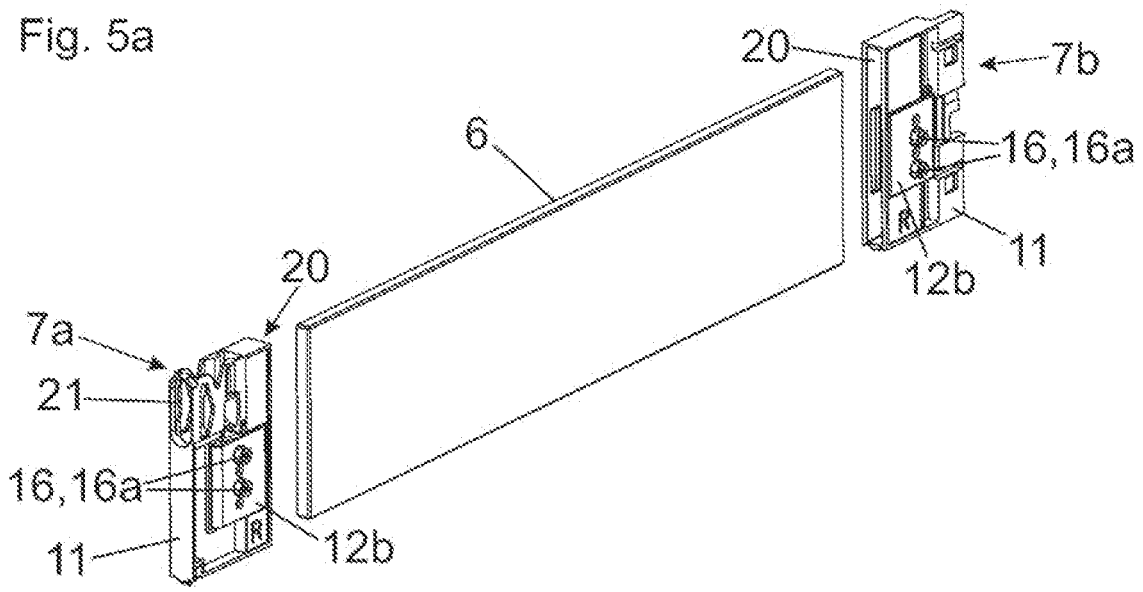
FIGS. 5*a*-5*c* show the mounting operation of the holding device on the decorative plate.
Figure 5B:
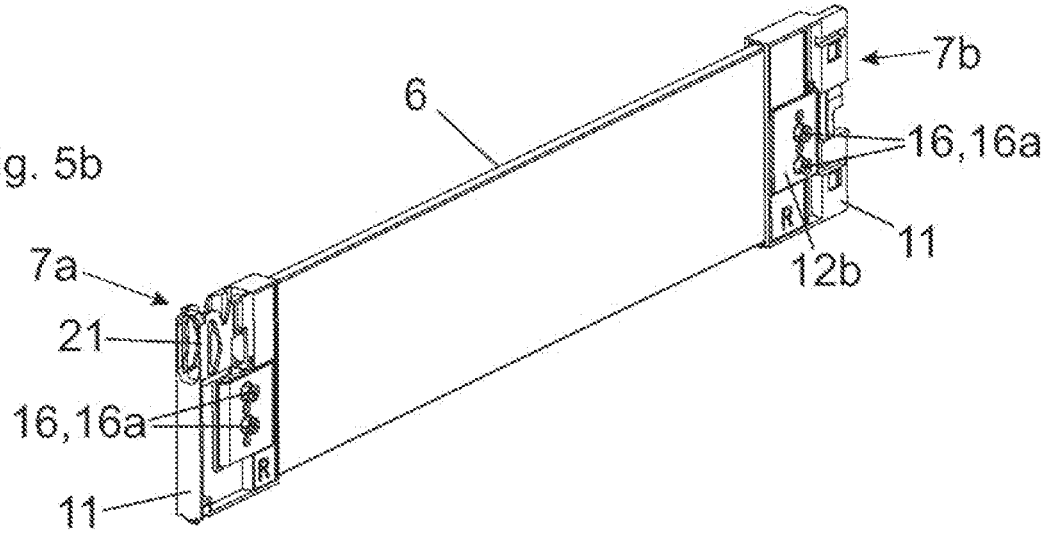
Figure 5C:
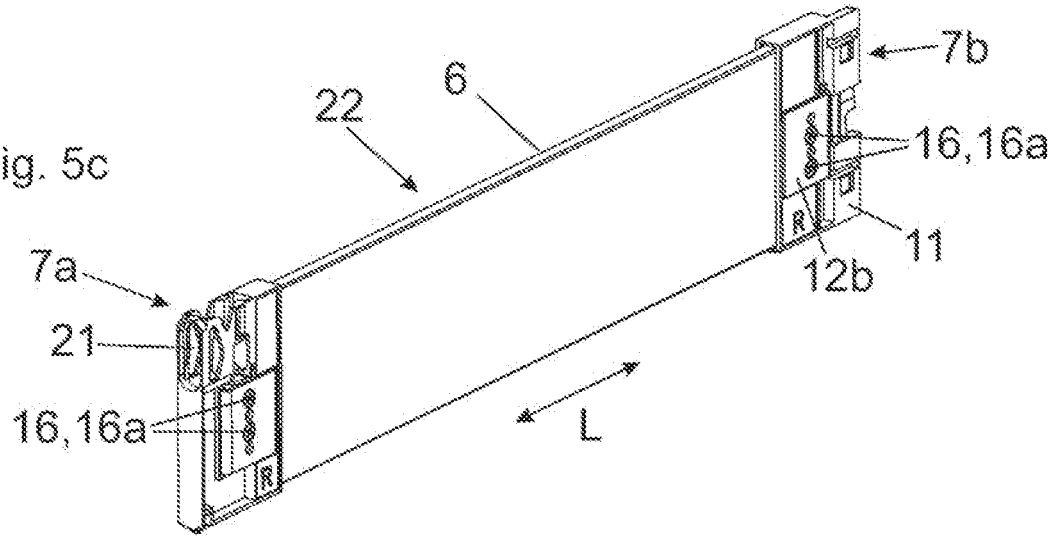

FIG. 5*a*-5*c* show the mounting operation of the holding devices 7*a*, 7*b* on the decorative plate 6. Firstly, the holding devices 7*a*, 7*b* are slid onto the two end portions of the decorative plate 6. For this purpose, the base bodies 11 of the holding devices 7*a*, 7*b* each include a receiving chamber 20 which can be configured substantially rectangular in a cross-section.

FIG. 5*b* shows the holding devices 7*a*, 7*b* that have been slid onto the end portions of the decorative plate 6. The adjustment device 16 for adjusting the clamping force acting on the decorative plate 6 has not yet been actuated.

FIG. 5*c* shows the decorative plate 6 with the holding devices 7*a*, 7*b*, the decorative plate 6 being fixed within the receiving chamber 20 in a clamping manner by an actuation of the adjustment device 16, preferably by the clamping screws 16*a*. The construction shown in FIG. 5*c* corresponds to the attachment device 22 by which the surface of the drawer sidewall 2*a*, 2*b*, in a direction transverse to a longitudinal direction (L) of the drawer sidewall 2*a*, 2*b*, can be enlarged. The attachment device 22 includes at least one, preferably two, holding device(s) 7*a*, 7*b*.

The method for mounting a decorative plate 6 to at least one holding device 7*a*, 7*b* is characterized by the following method steps:

the at least one holding device 7*a*, 7*b* is provided, the decorative plate 6 is provided, the decorative plate 6 is partially arranged between the at least two holding limbs 12*a*, 12*b* of the holding device 7*a*, 7*b*, and a clamping force is applied to the decorative plate 6 received between the at least two holding limbs 12*a*, 12*b* in a direction extending transverse to a longitudinal direction (L) of the decorative plate 6.

Figure 6A:
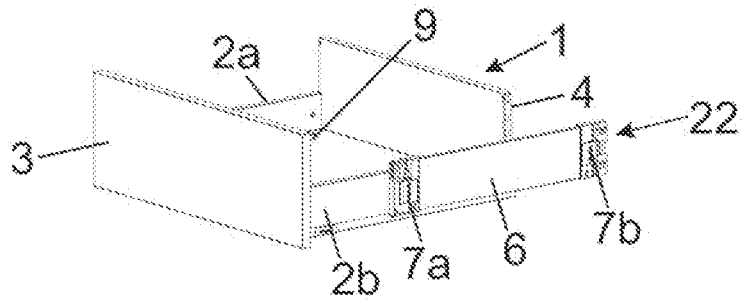
FIG. 6*a*-6*e* show the mounting operation of the attachment device on the drawer.
Figure 6B:
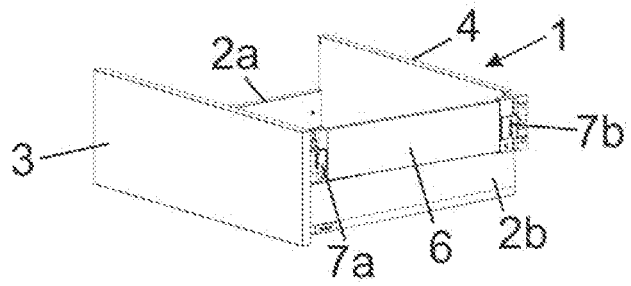
Figure 6C:
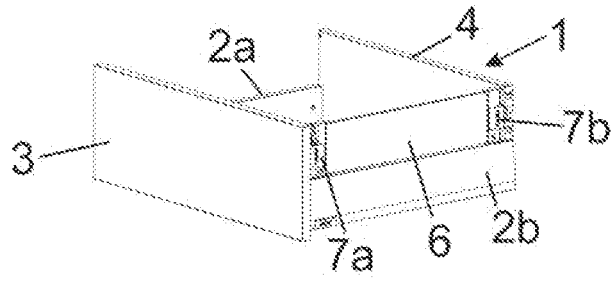
Figure 6D:
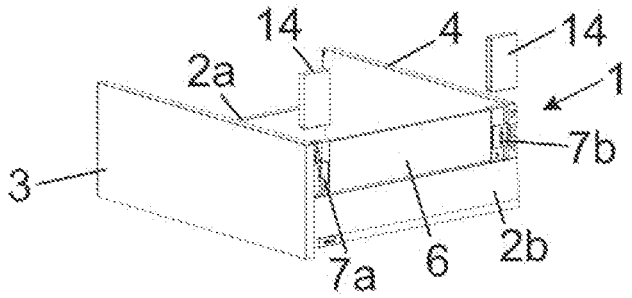
Figure 6E:
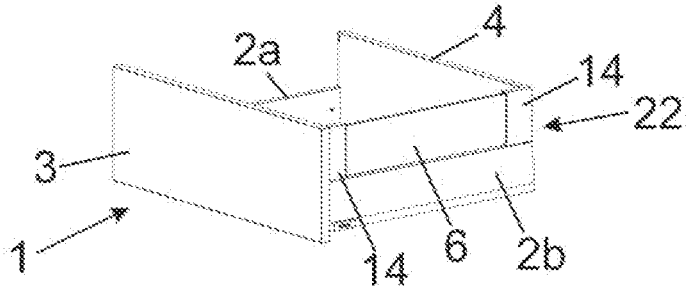

FIG. 6*a*-6*e* show the mounting operation of the attachment device 22 on the drawer 1. In a first step, the front holding device 7*a* is slid onto the fitting element 9 premounted to the rear side of the front panel 3 (FIG. 1*b*). In a next step, the rear end portion of the decorative plate 6 is pivoted in a direction towards the drawer sidewall 2*b*, until the rear holding device 7*b* can be locked with the drawer rear wall 4 (FIG. 6*c*). In a next step, the two cover devices 14 are provided (FIG. 6*d*). In a further step, the two cover devices 14 are slid onto the holding devices 7*a*, 7*b* from above (FIG. 6*e*).

With a possible embodiment of the invention, the at least two holding limbs 12*a*, 12*b* can be clamped onto the decorative plate 6 by placing the at least one cover device 14 over the at least two holding limbs 12*a*, 12*b*. This has the advantage that the decorative plate 6 can initially be prepositioned within the two holding limbs 12*a*, 12*b* in a force-free manner, and is only fixed in a force-locking manner by mounting the cover device 14.

The invention claimed is:

1. A holding device for holding a decorative plate configured to be set onto a drawer sidewall, the holding device comprising:

a fastening device for fixing the holding device to a front panel or to a drawer rear wall; and a clamping device having at least two mutually spaced holding limbs between which the decorative plate can be partially received, wherein the clamping device is configured for applying a clamping force to the decorative plate received between the at least two holding limbs in a direction extending transverse to a longitudinal direction of the decorative plate, wherein the clamping device includes at least one adjustment device for adjusting the clamping force that can be applied to the decorative plate between the at least two holding limbs, and wherein the at least one adjustment device includes at least one clamping screw, the at least one clamping screw being connected or being configured to be connected to the at least two holding limbs.

2. The holding device according to claim 1, wherein at least one of the at least two holding limbs includes a clamping surface configured to clampingly rest against the decorative plate.

3. The holding device according to claim 1, wherein the at least two holding limbs are connected to one another or are configured to be connected to one another by at least one transverse limb.

4. The holding device according to claim 1, wherein the holding device includes at least one base body, and each holding limb of the at least two holding limbs includes a first end at which the holding limb can be connected to the base body and a second end configured to rest against the decorative plate.

5. The holding device according to claim 1, wherein at least one cover device is provided, the at least one cover device being configured to cover at least the at least two holding limbs, wherein the at least two holding limbs can be clamped onto the decorative plate by placing the at least one cover device over the at least two holding limbs.

6. The holding device according to claim 1, wherein at least one limiting element is arranged between the at least two holding limbs, the at least one limiting element being configured to limit the clamping force that can be applied to the decorative plate.

7. The holding device according to claim 1, wherein the holding device includes at least one base body.

8. The holding device according to claim 1, wherein the fastening device includes a hole for introducing a fitting element configured to be fixed to the front panel or to the rear wall, or includes at least one locking protrusion.

9. An attachment device for a drawer sidewall, wherein the attachment device includes the holding device according to claim 1, and wherein by the attachment device, a surface of the drawer sidewall in a direction extending transverse to a longitudinal direction of the drawer sidewall can be enlarged.

10. The attachment device according to claim 9, wherein the attachment device includes a decorative plate configured to be set onto the drawer sidewall.

11. A drawer comprising the attachment device according to claim 9.

12. A method for mounting a decorative plate to the holding device according to claim 1, comprising:

providing the holding device;

providing the decorative plate;

partially arranging the decorative plate between the at least two holding limbs of the holding device; and applying a clamping force to the decorative plate received between the at least two holding limbs in the direction extending transverse to the longitudinal direction of the decorative plate.

13. The holding device according to claim 2, wherein each of the at least two holding limbs includes a clamping surface configured to clampingly rest against the decorative plate, and wherein each clamping surface includes at least one elastic compensating element, or is configured to be substantially flat so as to be free from protrusions to be countersunk within the decorative plate.

14. The holding device according to claim 4, wherein a distance between the at least two holding limbs in the direction transverse to the longitudinal direction of the decorative plate decreases from the first ends in a direction toward the second ends, and wherein the second ends of the at least two holding limbs can be spread apart relative to one another upon receiving the decorative plate.

15. The holding device according to claim 7, wherein the at least one base body includes at least one spring element configured to at least partially compensate for a clearance occurring in a longitudinal direction of the decorative plate, or includes a bearing device for the at least two holding limbs, or includes a receiving chamber configured to receive an end portion of the decorative plate.

16. The holding device according to claim 8, wherein the fastening device includes the hole, and wherein the hole is a keyhole.

17. The attachment device according to claim 9, wherein the holding device is one of a pair of holding devices included in the attachment device.

18. The attachment device according to claim 10, wherein the decorative plate is a glass panel which is configured entirely free from openings or recesses.

19. The holding device according to claim 1, wherein the at least one clamping screw, in a connected condition with the at least two holding limbs, is arranged between a front face of the decorative plate and the front panel or between the front face of the decorative plate and the drawer real wall.

20. A holding device for holding a decorative plate configured to be set onto a drawer sidewall, the holding device comprising:

a fastening device for fixing the holding device to a front panel or to a drawer rear wall; and a clamping device having at least two mutually spaced holding limbs between which the decorative plate can be partially received, wherein the clamping device is configured for applying a clamping force to the decorative plate received between the at least two holding limbs in a direction extending transverse to a longitudinal direction of the decorative plate, wherein the clamping device includes at least one adjustment device for adjusting the clamping force that can be applied to the decorative plate between the at least two holding limbs, and wherein at least one limiting element is arranged between the at least two holding limbs, the at least one limiting element being configured to limit the clamping force that can be applied to the decorative plate.

* * * * *